US006115964A

United States Patent [19]

Hix

[11] Patent Number: 6,115,964

[45] Date of Patent: Sep. 12, 2000

[54] VEHICLE ACTIVATED COLLAPSIBLE GATE

[76] Inventor: Runa D. Hix, 520 Powell Hollow Rd., Tullahoma, Tenn. 37388

[21] Appl. No.: 09/323,201

[22] Filed: Jun. 1, 1999

Related U.S. Application Data

[60] Provisional application No. 60/087,121, May 29, 1998.

[51] Int. Cl.[7] ..... E05F 13/04; E05F 13/00; E06B 11/00

[52] U.S. Cl. ..... 49/134; 49/132; 49/269

[58] Field of Search ..... 49/132, 134, 133, 49/263, 269, 264, 271, 270, 274, 273, 131; 256/73, 24, 26, 25, 1

[56] References Cited

U.S. PATENT DOCUMENTS

| | | | |
|---|---|---|---|
| 1,247,817 | 11/1917 | Gilkey . | |
| 1,498,458 | 6/1924 | Lancaster | 49/132 |
| 1,536,992 | 11/1925 | Wallace . | |
| 1,544,022 | 6/1925 | Miller | 49/131 |
| 1,551,340 | 1/1925 | Smith . | |
| 1,759,207 | 5/1930 | Rose et al. | 49/132 |
| 2,007,071 | 1/1935 | Burns . | |
| 2,200,727 | 9/1940 | Swenson . | |
| 2,256,662 | 9/1941 | Blaker | 49/132 |
| 2,527,129 | 10/1950 | Hale | 49/132 |
| 2,543,893 | 3/1951 | Chandler . | |
| 2,622,354 | 12/1952 | Bacon | 49/33 |
| 2,758,399 | 8/1956 | Youle et al. . | |
| 2,925,674 | 2/1960 | Madden | 49/273 |
| 3,024,549 | 3/1962 | Lubmann | 49/131 |
| 3,089,267 | 5/1963 | Wooden . | |
| 3,303,613 | 2/1967 | Seuntjens | 49/131 |
| 4,475,310 | 10/1984 | Brewer | 49/131 |
| 4,708,515 | 11/1987 | Davies | 49/131 X |

*Primary Examiner*—Daniel P. Stodola
*Assistant Examiner*—Hugh B. Thompson
*Attorney, Agent, or Firm*—Dykema Gossett PLLC

[57] ABSTRACT

A gate structure is mounted for pivotal movement about a horizontal axis between a closed raised position and a lowered open position. A pair of operating mechanisms each include a horizontal member and a pair of support members. The horizontal members are pivotally connected at their medial portions to the gate structure. The opposite ends of each of the horizontal members are pivotally connected to one end of the associated support members which in turn have the opposite ends thereof mounted for pivotal movement about horizontal axes. Closing devices are connected to opposite sides of the gate structure for normally maintaining the gate structure in its closed raised position.

7 Claims, 4 Drawing Sheets

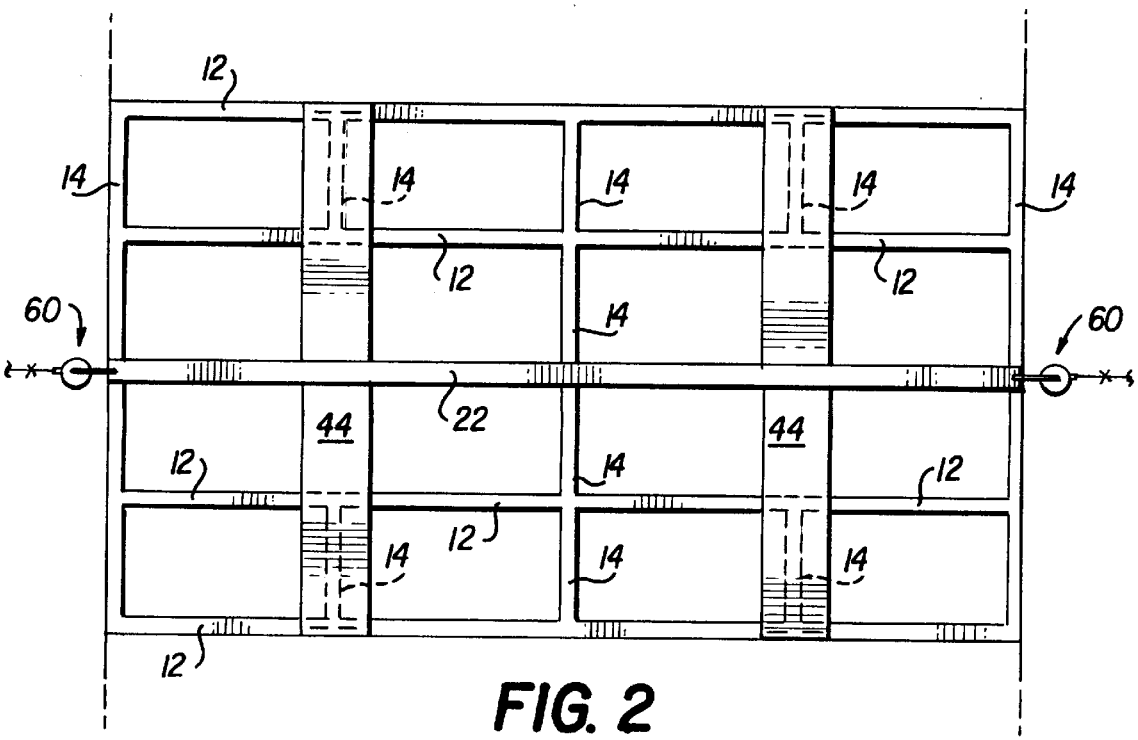
FIG. 2
FIG. 3
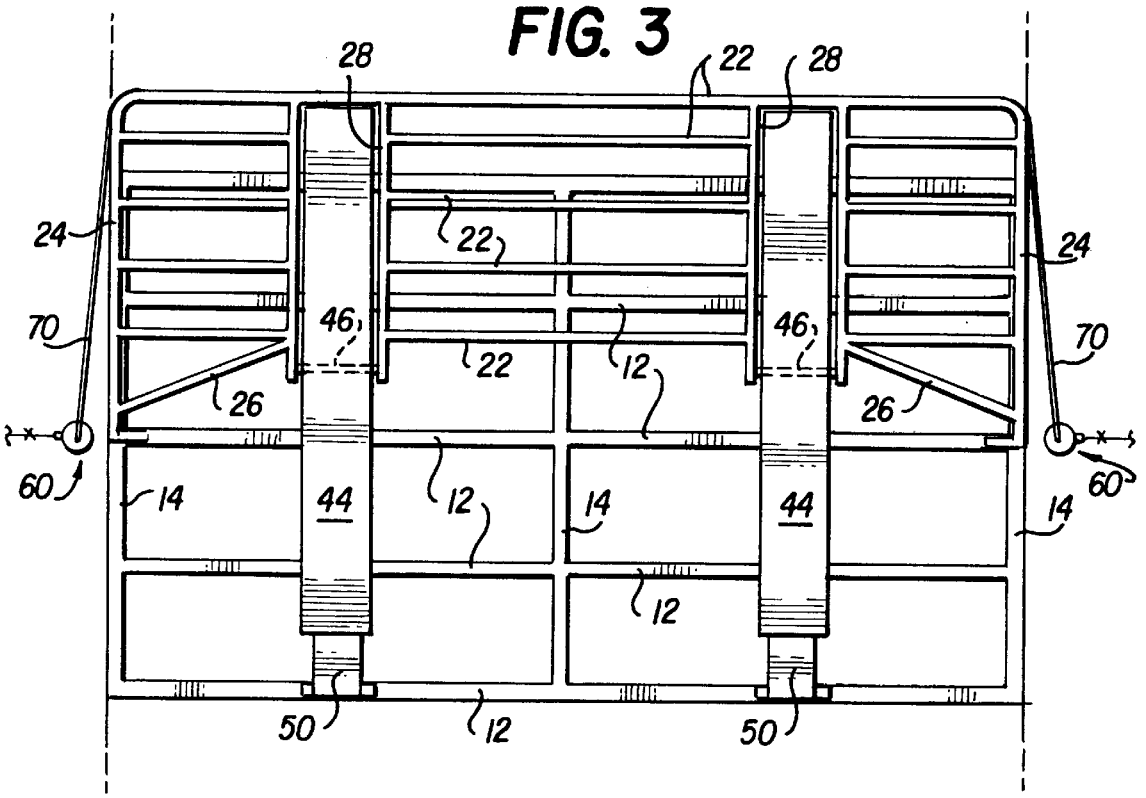

VEHICLE ACTIVATED COLLAPSIBLE GATE

CROSS-REFERENCE TO RELATED APPLICATION

This application is derived from U.S. Provisional Application Ser. No. 60/087,121, filed May 29, 1998.

BACKGROUND OF THE INVENTION

The present invention relates to a vehicle activated collapsible gate, and more particularly to a gate which is used in conjunction with a fence enclosing an area containing livestock such as cattle, horses, and the like.

Such gates are designed to provide an effective barrier to livestock, but are adapted to be opened by vehicles passing through the gateway in opposite directions without the necessity of stopping the vehicle to open the gate. Furthermore, the gate is provided with means for returning the gate to closed position after a vehicle has moved away from the gate.

SUMMARY OF THE INVENTION

The present invention provides a gate structure which is mounted at its lower portion for pivotal movement about a horizontal axis such that it can pivot between a closed raised or vertical position and an open lowered or horizontal position.

Novel means is provided for operating the gate in the form of a pair of spaced operating mechanisms each of which includes a generally horizontally extending member which is pivotally connected to the gate structure. A pair of support members are pivotally mounted about horizontal axes and are also pivotally connected to the opposite ends of each of the generally horizontally extending members.

Closing means is provided for normally retaining the gate structure in its closed raised vertical position. Assuming that the gate structure is in its raised position, when a vehicle approaches the gate, the tires of the vehicle initially engage the support members at one end of the gate structure. Further movement of the vehicle toward the gate structure will cause the gate structure to pivot into its lowered horizontal open position. The tires of the vehicle progressively move along the support members at one end of the gate, thence along the generally horizontally extending members which are spaced from one another a distance such that they can support the tires of vehicles normally used with livestock.

When the tires of the vehicle are no longer supported on the operating mechanisms and the vehicle moves away from the gate, the closing means will automatically return the gate to its closed raised vertical position.

BRIEF DESCRIPTION OF THE DRAWINGS

FIG. 2 is a top view of the gate shown in FIG. 1;

FIG. 3 is a top view of the gate in its open lowered position;

DESCRIPTION OF THE PREFERRED EMBODIMENT

Figure 1:
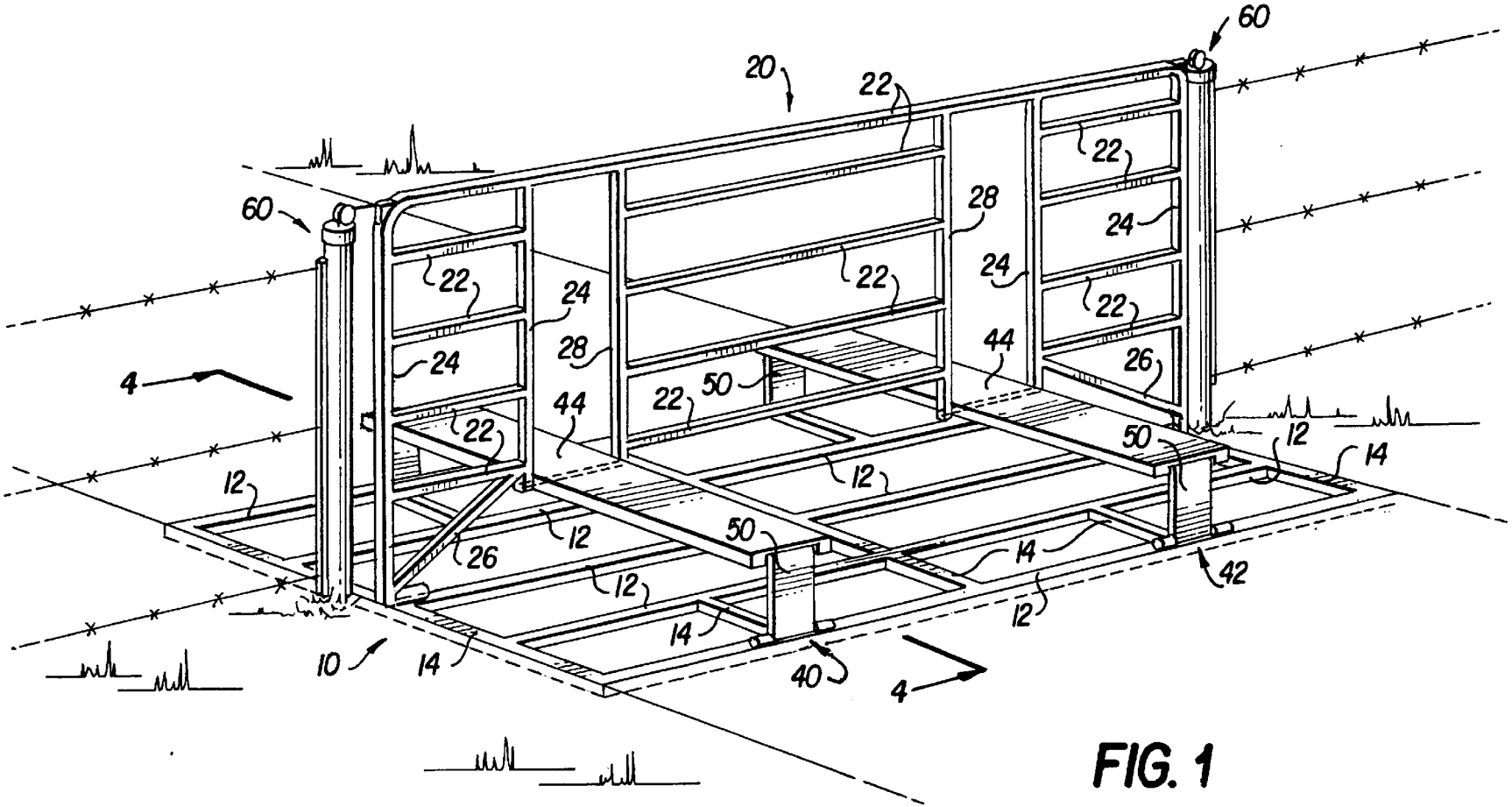
FIG. 1 is a top perspective view of the gate in closed raised position.

Referring now to the drawings wherein like reference characters designate corresponding parts throughout the several views, There is shown in FIGS. 1–3 a rigid base structure 10 formed of steel members which may be angle members or tubular members of generally square cross-section to provide the necessary strength to support the gate. The base structure includes a first plurality of generally parallel members 12 which are welded to a second plurality of generally parallel members 14 which are disposed substantially perpendicular to members 12.

The gate structure comprises an open framework 20 which as seen in FIG. 1 includes a plurality of horizontally extending members 22 and vertically extending members 24 similar to the members forming the base structure. Members 22 are welded to members 24. A pair of diagonally extending members 26 are welded between certain vertically extending members as shown. Framework 20 defines a pair of openings 28 for a purpose hereinafter described. The various openings defined by framework 20 do not allow livestock to pass therethrough, thereby forming an effective barrier.

Figure 4:
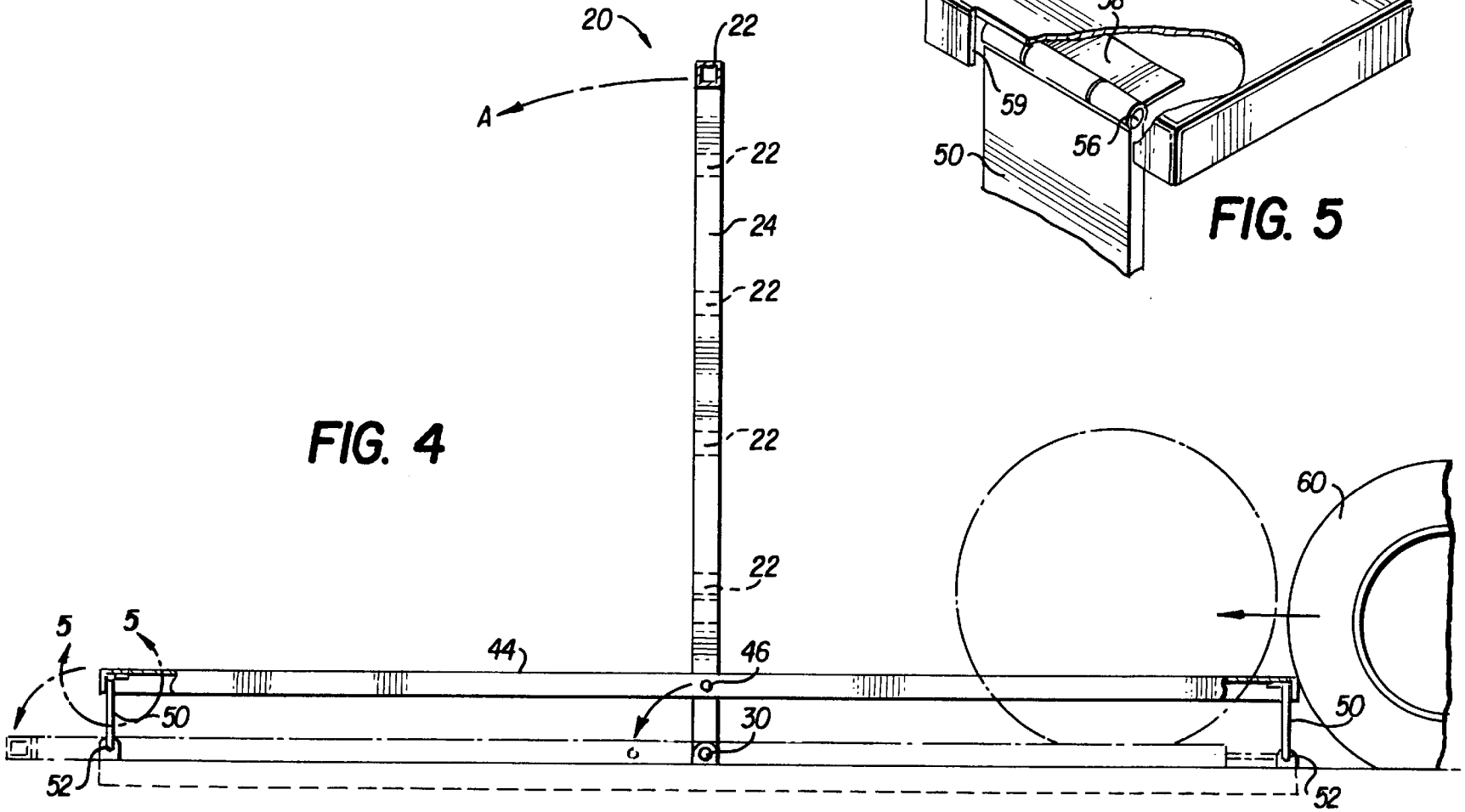
FIG. 4 is view taken along line 4—4 of FIG. 1 showing the gate in its vertical position in solid lines and showing the gate in its horizontal position in broken lines.

The two vertical members 24 at opposite sides of the framework are pivotally supported at the lower ends thereof on members 14 at opposite sides of the base structure by pins 30, one of which is seen in FIG. 4, such that the gate structure is mounted for pivotal movement about a horizontal axis.

A pair of operating mechanisms 40 and 42 are spaced from one another and are of similar construction. Accordingly, similar reference numerals are applied to the corresponding components of both operating mechanisms. Each operating mechanism comprises a generally horizontally extending member 44 formed of steel which is capable of supporting the tires of a vehicle. Each member 44 has opposite ends, and a medial portion thereof is pivotally connected to the gate framework by a pivot pin 46 which extends through member 44 and the adjacent members 24 of the framework to provide a horizontal pivotal axis. In this manner, movement of members 44 in opposite directions parallel to base members 14 is translated into pivotal movement of the gate between raised and lowered positions.

Four support members 50 are provided, a first pair of members 50 being pivotally connected with opposite ends of one member 44 and a second pair of members 50 being pivotally connected with opposite ends of the other member 44. Each member 50 is pivotally connected to a base member 12 at the lower end thereof at 52 as seen in FIG. 4 for pivotal movement about a horizontal axis.

Figure 5:
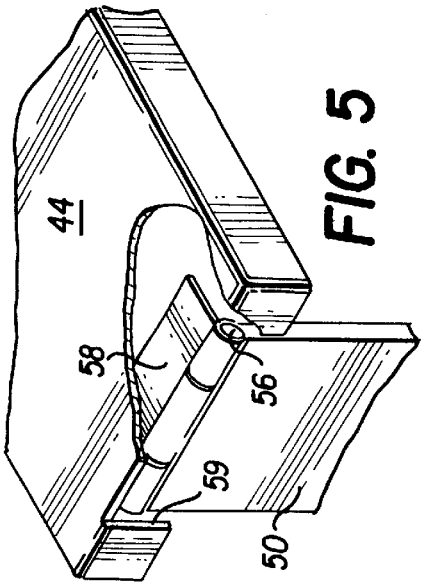
FIG. 5 is an enlarged top perspective view partly broken away of the portion of the structure shown in FIG. 4 as indicated by arrow 5—5.

As seen in FIG. 5, the upper end of each member 50 is pivotally connected by a pivot pin 56 with a plate 58 which may be welded to member 44 so as to pivotally connect the opposite ends of each member 44 to the upper end of support members 50. The depending flange of member 44 is provided with a cutout 59 to allow members 44 and 50 to move into lowered horizontal position.

Assuming that the gate structure is in its raised position as shown in FIGS. 1, 2 and 4, and a vehicle approaches the gate from the right as seen in FIG. 4, the tire 60 as shown in solid lines first comes into contact with the end of members 44 and members 50. As the vehicle proceeds to the left in FIG. 4, the tire progressively moves along members 50 at the right side of FIG. 4, thence along the upper surface of members 44 to move members 44 and 50 into the broken line position shown in FIG. 4. This causes the gate structure 20 to pivot in a counterclockwise direction as indicated by arrow A so that the gate structure is moved into a horizontal position (not shown for the sake of clarity). It is further noted that the entire gate arrangement is symmetrical so that it will be operated by a vehicle moving in either of opposite directions through the gateway.

Referring to FIG. 3, the gate structure is shown in its closed lowered position. In this position, the upper ends of members 44 as seen in the figure are received within openings 28 with some clearance so as to prevent any interference with the free movement of the gate components.

Figure 6:
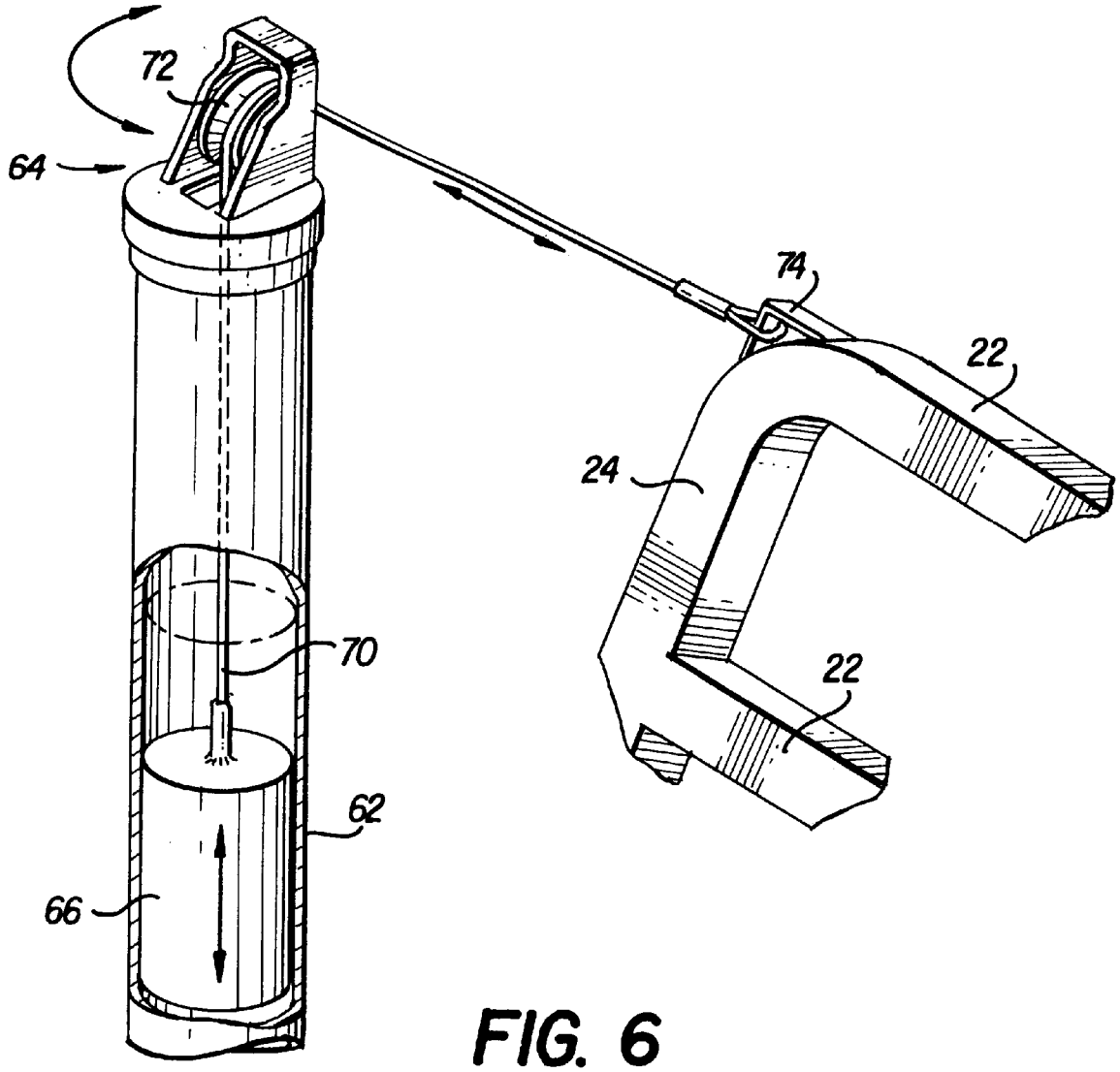
FIG. 6 is a top perspective view, broken away, showing the closing means.

As seen in FIG. 1, a pair of similar closing means 60 are provided at opposite sides of the gate. The details of construction of each of the closing means is shown in FIG. 6. The closing means may be of a construction such as that shown in U. S. Pat. No. 4,475,310 and comprises a hollow rigid post 62 having a cap 64 rotatably supported at the upper end thereof by suitable bearing means. A weight 66 is movably supported within the post and is connected to one end of a flexible cable 70. The cable passes over a pulley 72 rotatably supported by cap 64, the opposite end of the cable being connected to a fitting 74 connected to an upper corner of the gate structure. It is apparent that the closing means normally biases the gate structure into its closed raised position regardless of which direction the gate structure pivots during use. Conventional metallic springs or gas springs may also be used as closing means if so desired.

If it is desired to delay the operation of the closing means to allow a vehicle to clear the gate structure before the gate structure is returned to its raised position, conventional means such as a gas spring may be connected to the weight 66 to delay its movement downward within post 62. As is well known, the operating characteristics of gas springs may be controlled by the configuration of the orifice means therein.

What is claimed is:

1. A vehicle activated collapsible gate movable between a closed raised position and an open lowered position comprising, a gate framework mounted for pivotal movement about a generally horizontal axis and lying substantially in a vertical plane when in closed raised position, a pair of spaced operating mechanisms for moving the gate structure to a lowered position, each of said operating mechanisms including an elongated generally horizontally extending member which extends substantially perpendicular to said plane and extends a substantial distance on opposite sides of said plane when the framework is in the closed raised position, each generally horizontally extending member having a substantially flat upper surface for supporting wheels of a vehicle and being pivotally connected to said gate structure, each operating mechanism also including a pair of support members each of which is mounted for pivotal movement about a generally horizontal axis and is pivotally connected to the generally horizontally extending member of the associated operating mechanism, and closing means normally biasing said gate structure into raised position.

2. A gate as defined in claim 1 wherein each of said generally horizontally extending members has opposite end portions, each pair of support members being pivotally connected to the opposite end portions of the generally horizontally extending member of the associated operating mechanism.

3. A gate as defined in claim 1 wherein each of said generally horizontally extending members has a medial portion, each of said generally horizontally extending members having the medial portion thereof pivotally connected to said gate.

4. A gate as defined in claim 1 wherein said support members connected to each of said generally horizontally extending members are disposed substantially parallel to one another in all positions of the gate structure.

5. A vehicle activated collapsible gate movable between a closed raised position and an open lowered position comprising, a gate structure having an upper portion, a lower portion and a pair of side portions, said side portions being pivotally mounted for pivotal movement about a first generally horizontal axis and lying substantially in a vertical plane when in a closed raised position, a pair of spaced operating mechanisms for moving the gate structure to a lowered position, each of said operating mechanisms including a generally horizontally extending member having opposite end portions and a medial portion, said generally horizontally extending member extending substantially perpendicular to said plane and extending a substantial distance on opposite sides of said plane when said gate structure is in the closed raised position, each generally horizontally extending member having substantially flat upper surface for supporting wheels of a vehicle, said medial portion being pivotally connected to said gate structure for pivotal movement about a second generally horizontal axis spaced from and parallel to said first axis, each of said operating mechanisms also including a pair of support members each of which is pivotally mounted for pivotal movement about a generally horizontal axis spaced from and parallel to said first axis and said second axis, said pair of support members of each operating mechanism also being pivotally connected to the opposite end portions of the generally horizontally extending member of the associated operating mechanism, and closing means for returning said gate structure to raised position after it has been moved to lowered position by a vehicle.

6. A gate as defined in claim 5 wherein said side portions of the gate structure are pivotally mounted adjacent said lower portion of the gate structure.

7. A gate as defined in claim 5 wherein said gate structure comprises a framework defining a pair of openings for receiving the generally horizontally extending members of the operating mechanisms when the gate structure is in lowered position.

* * * * *